US005895314A

United States Patent [19]

Kitao et al.

[11] Patent Number: 5,895,314

[45] Date of Patent: Apr. 20, 1999

[54] LENS SHAPE MEASURING APPARATUS

[75] Inventors: Ikuo Kitao; Yoshiyuki Hatano; Toshihiro Iwai; Takeshi Nakamura; Hisao Fujinuma; Shinji Uno; Jun Akiyama, all of Tokyo, Japan

[73] Assignee: Kabushiki Kaisha TOPCON, Tokyo, Japan

[21] Appl. No.: 09/084,055

[22] Filed: May 26, 1998

[30] Foreign Application Priority Data

May 26, 1997 [JP] Japan ..... 9-151635

[51] Int. Cl.[6] ..... B24B 1/00; B24B 7/19; B24B 7/30

[52] U.S. Cl. ..... 451/43

[58] Field of Search ..... 350/177, 178, 350/246; 73/104, 105, 865.8, 865.9; 451/5, 42, 43, 210, 255, 256

[56] References Cited

U.S. PATENT DOCUMENTS 5,716,256 2/1998 Mizuno et al. ..... 451/43

5,803,793 9/1998 Mizuno et al. ..... 451/5

FOREIGN PATENT DOCUMENTS 7-314307 12/1995 Japan .

*Primary Examiner*—William Oen

*Attorney, Agent, or Firm*—Finnegan, Henderson, Farabow, Garrett & Dunner, L.L.P.

[57] ABSTRACT

A lens shape measuring apparatus is provided which comprises lens rotating shafts (16, 17) for rotatably holding an uncut lens, a feeler (63, 219, 220) disposed in contact with a working locus of the front or rear surface of the lens, and a calculation/control circuit (100) for detecting a difference in surface level of the lens from a change in data measured by the feeler (63, 219, 220) and controlling the contact of the feeler with the lens 6 Claims, 15 Drawing Sheets

LENS SHAPE MEASURING APPARATUS

BACKGROUND OF THE INVENTION

1. Field of the Invention

The present invention relates to a lens shape measuring apparatus for measuring an edge thickness of an eyeglass lens to be fitted into a lens opening of an eyeglass frame.

2. Description of the Related Art

A typical one of the conventional edge thickness measuring apparatuses used to edge an uncut lens is disclosed in Japanese Laid-Open Patent Publication No. Hei 7-314307 in which an edge thickness of an uncut lens for fitting into a lens opening of an eyeglass frame is measured using a freely rotatable feeler which is to be placed on a working locus on each of the front and rear surfaces of the lens, the working locus having a predetermined relationship to the lens opening (lens frame) or to a lens-shaped template.

This conventional apparatus was proposed to prevent the feeler from damaging the refracting surface of an uncut lens during measurement or prevent the feeler itself from being deformed or broken because of receiving a frictional resistance from the front or rear surface of the lens or lens-shaped template.

Especially, when measuring an edge thickness of an eyeglass lens having a stepped boundary (i.e., having a difference in surface level of the eyeglass lens) between a distance portion (farsighted portion) and a near portion (nearsighted portion) of the eyeglass lens (i.e., EX lens), a feeler will be caught by the stepped portion, and thus the edge thickness of the lens cannot be accurately measured if the feeler is merely slid in contact with the front or rear refracting surface of the lens during measurement. The conventional apparatus was provided to solve this problem.

However, in the conventional apparatus, there is still a fear that a feeler constructed of merely rotatable members cannot go beyond a stepped portion generated by a great difference in thickness between the distance and near portions of, for example, an EX lens, and will be caught by the stepped portion when the feeler is slid from the thin part to the thick part of the EX lens by the rotation of the EX lens.

Additionally, the conventional apparatus cannot determine the degree of a difference in surface level of an EX lens, and thus cannot accurately measure the edge thickness of the EX lens on the whole edge thereof.

As a result, it is impossible to produce an eyeglass lens having an exact fit to an eyeglass frame and provide nice-looking eyeglasses according to the taste of an eyeglass wearer.

SUMMARY OF THE INVENTION

It is therefore an object of the present invention to provide a lens shape measuring apparatus which is capable of determining the degree of a difference in surface level of an eyeglass lens based on a variation in measurement data obtained by a feeler and, when the level difference is great, accurately measuring the edge thickness of the lens on the whole edge thereof by controlling the rotational direction of the lens or controlling the contact position of the feeler with the lens, and, as a result, edging the uncut lens so as to have an exact fit to an eyeglass frame.

In order to achieve the object, a lens shape measuring apparatus of the present invention comprises lens rotating shafts to rotatably hold an uncut lens; a shaft rotating means for rotating the shafts about their axes; a rotation detecting means for detecting a quantity of rotation of the shafts; a feeler disposed in contact with a working locus, along which the uncut lens is cut or edged, of a refracting surface of the uncut lens; a feeler moving means for moving the feeler in a direction perpendicular to an optical axis of the lens; a distance detecting means for detecting a distance of movement of the feeler relative to the lens in a direction of the optical axis of the lens; and a control means for detecting a difference in surface level of the lens, based on output of the rotation detecting means and output of the distance detecting means, and controlling the contact of the feeler with the refracting surface of the lens.

Preferably, the control means brings the feeler into contact with one of front and rear refracting surfaces of the lens, and thereafter controls the shaft rotating means and the feeler moving means to move the feeler relatively with the one of front and rear refracting surfaces along the working locus and measure the one of front and rear refracting surfaces, and thereafter the control means brings the feeler into contact with the other refracting surface of the lens, and thereafter controls the shaft rotating means and the feeler moving means to move the feeler relatively with the other refracting surface along the working locus and measure the other refracting surface, and, based on measurement results of the front and rear refracting surfaces obtained from the output of the rotation detecting means and the output of the distance detecting means, the control means calculates an edge thickness of the lens along the working locus.

The apparatus may be constructed to have a pair of feelers disposed to come into contact with the front and rear refracting surfaces of the lens, respectively. In this apparatus, the distance detecting means measures an interval between the pair of feelers, and the control means calculates an edge thickness of the lens along the working locus, based on output of the rotation detecting means and output of the distance detecting means.

Preferably, the control means determines whether a variation of measurement data measured by the feeler along the working locus is gradual or abrupt, based on the output of the rotation detecting means and the output of the distance detecting means, and, if abrupt, the control means judges that the lens is a bifocal lens, and allows the feeler to again measure the lens from a position where the lens has a level difference causing an abrupt change to another position of having a level difference.

When the control means judges that the lens is a bifocal lens, the control means may estimate a next position where the lens has a level difference, based on the position of the abrupt change, and bring the feeler into contact with the lens before the position of the abrupt change, while allowing the shaft rotating means to reverse the lens rotating shafts for a start of measurement and stopping the feeler before the estimated position on an opposite side to the position of the abrupt change on the same surface of the lens.

Preferably, when the feeler is moved from a lens portion having a higher surface level to a lens portion having a lower surface level, the control means is capable of measuring the position of the abrupt change.

BRIEF DESCRIPTION OF THE DRAWINGS

The object and features, aspects and advantages of the present invention will become more apparent from the following detailed description of the preferred embodiments of the present invention when taken in conjunction with the accompanying drawings, of which:

FIG. 6(*b*) is a perspective view for explanation of a working pressure adjusting unit shown in FIG. 6(*a*);

FIG. 8(*b*) is a sectional view taken along the line C—C of FIG. 8(*a*), showing a closed state;

FIG. 8(*c*) is a sectional view taken along the line C—C in FIG. 8(*b*), showing an opened state;

FIG. 8(*d*) shows the location of microswitches of FIG. 8(*a*);

FIG. 15(*b*) is a sectional view taken along the line B—B of FIG. 15(*a*);

FIG. 15(*c*) is a sectional view taken along the line C—C of FIG. 15(*b*);

FIG. 15(*d*) is an explanatory drawing showing the relationship between a rack and a pinion of FIG. 15(*b*)

DETAILED DESCRIPTION OF THE PREFERRED EMBODIMENTS

First Embodiment

A first embodiment of the present invention will be described with reference to the attached drawings.

Grinding Unit

Figure 13:
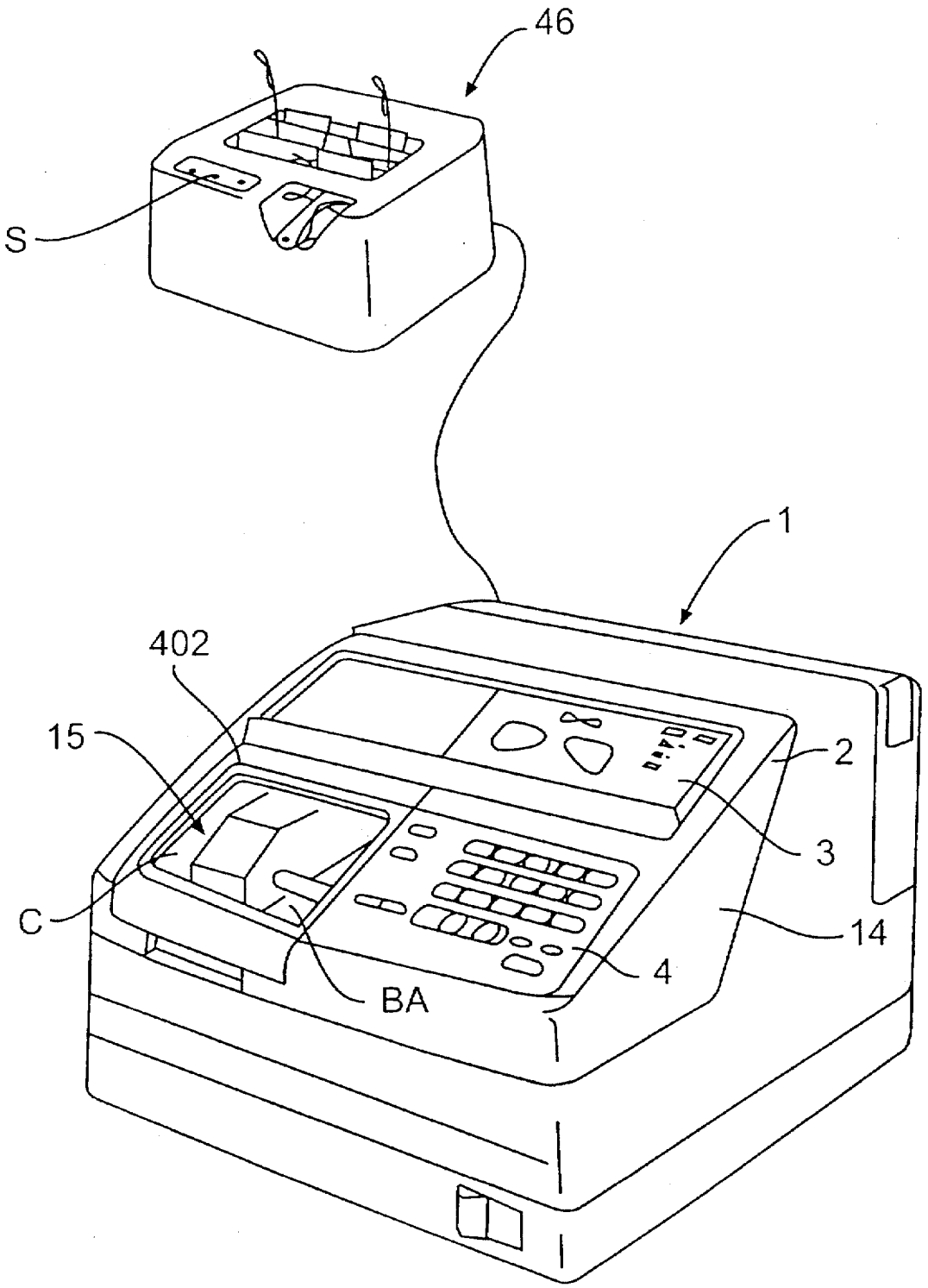
FIG. 13 is a perspective view of a lens edging apparatus having the construction shown in FIGS. 1 to 12.

In FIG. 13, reference numeral 1 designates a housing of a lens grinder. The housing 1 has a cover 14 with an inclined surface 2, an LC display 3 provided in the right upper half thereof, and a keyboard 4 in the right lower half thereof.

Figure 1:
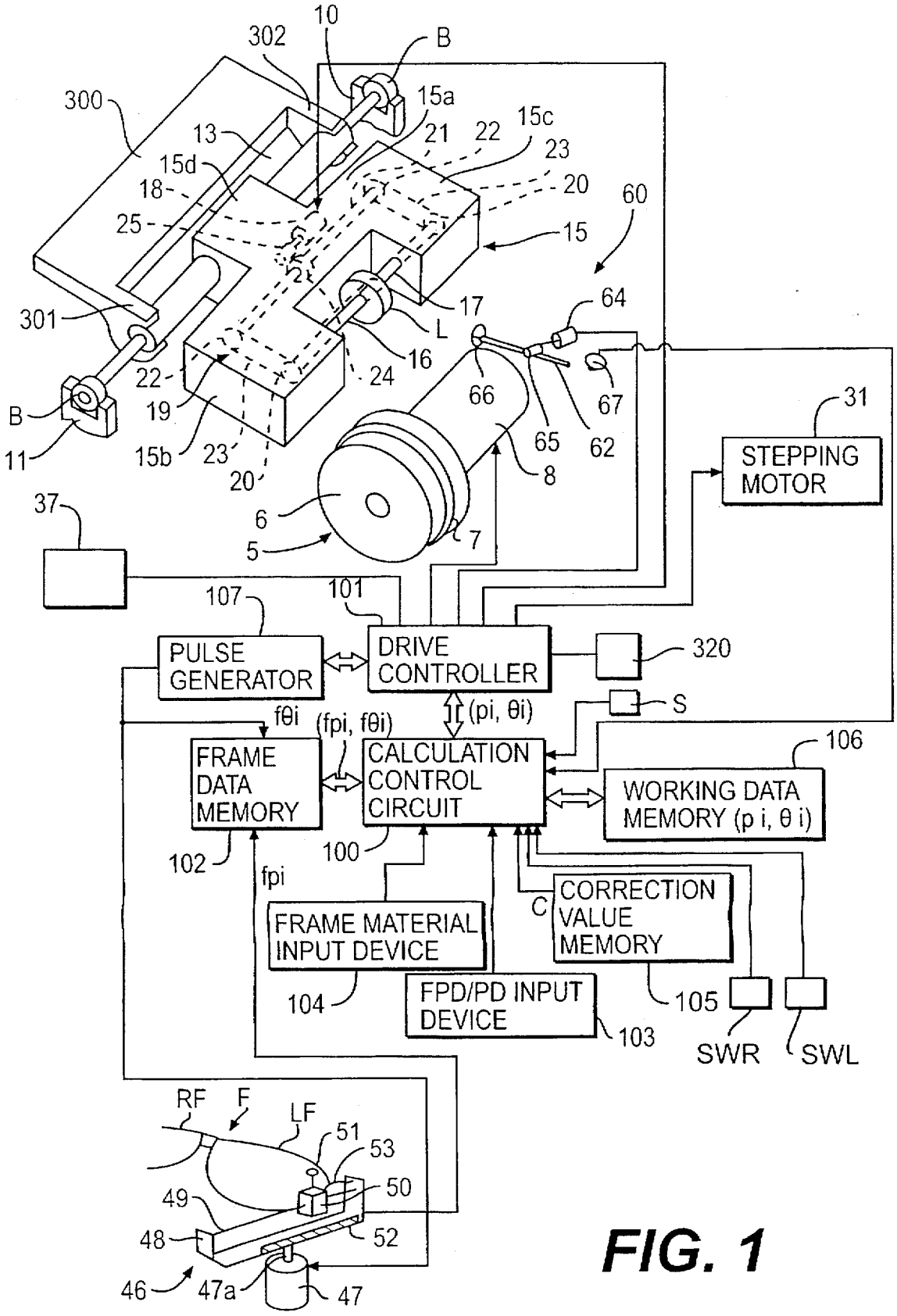
FIG. 1 schematically shows a first embodiment of the lens edging apparatus (i.e., lens grinder) according to the present invention, also showing the control circuit of the apparatus.

The housing 1 also has in the left portion thereof a working or grinding room BA in which a grinding wheel assembly 5 is rotatably supported as shown in FIG. 1. The grinding wheel assembly 5 comprises a rough grinding wheel 6 and a V-grooved grinding wheel 7. These grinding wheels 6 and 7 are driven and rotated by a motor 8 shown in FIG. 1.

Figure 5:
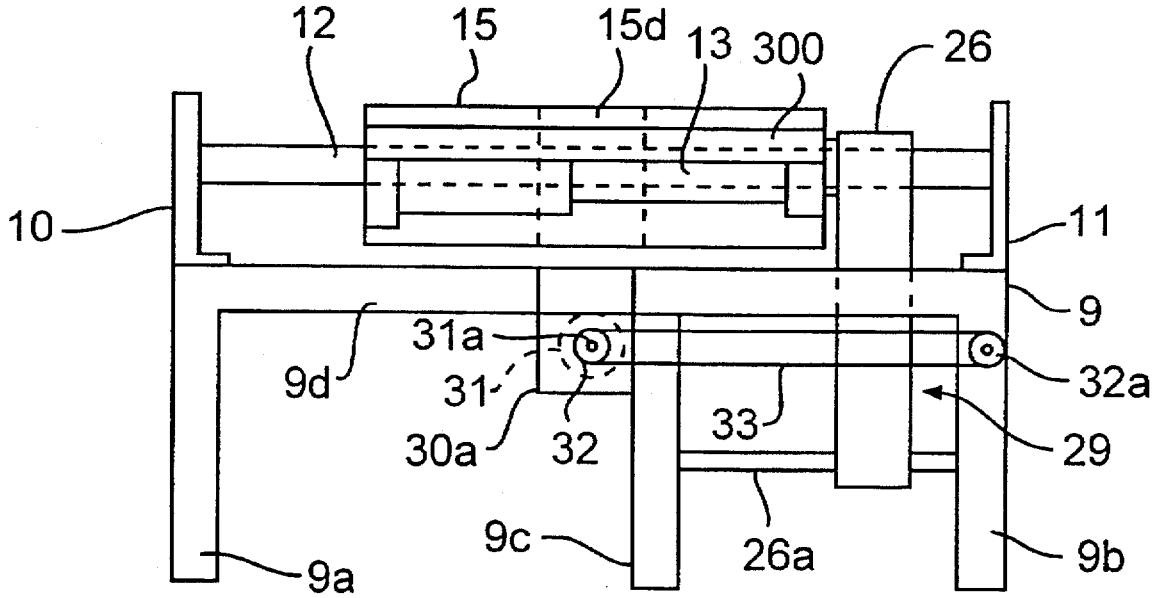
FIG. 5 is a schematic rear view of the apparatus of FIG. 1, showing the location of a lens carriage.

A carriage holder 9 shown in FIG. 5 is fixed inside the housing 1. The carriage holder 9 comprises left and right legs 9*a* and 9*b*, an intermediate leg 9*c* disposed between the legs 9*a* and 9*b* in a position nearer to the leg 9*b*, and a mount plate 9*d* to which all the legs 9*a* to 9*c* are fixed at their respective upper ends.

Under the covering case 14, there are provided upright brackets 10 and 11 at the opposite ends of the mount plate 9*d*. A support shaft 12 is provided between the brackets 10 and 11 and is fitted at either end thereof in bearings B provided on the top of the brackets 10 and 11, respectively. The support shaft 12 has a hollow cylindrical shaft 13 fitted to be axially movable. The support shaft 12 and cylindrical shaft 13 are located under the cover 14 as shown in FIG. 13.

Under the covering case 14, there are also provided a carriage 15, a plate-like swing arm 300, and a working pressure adjusting unit 310 mounted on the swing arm 300.

Figure 2:
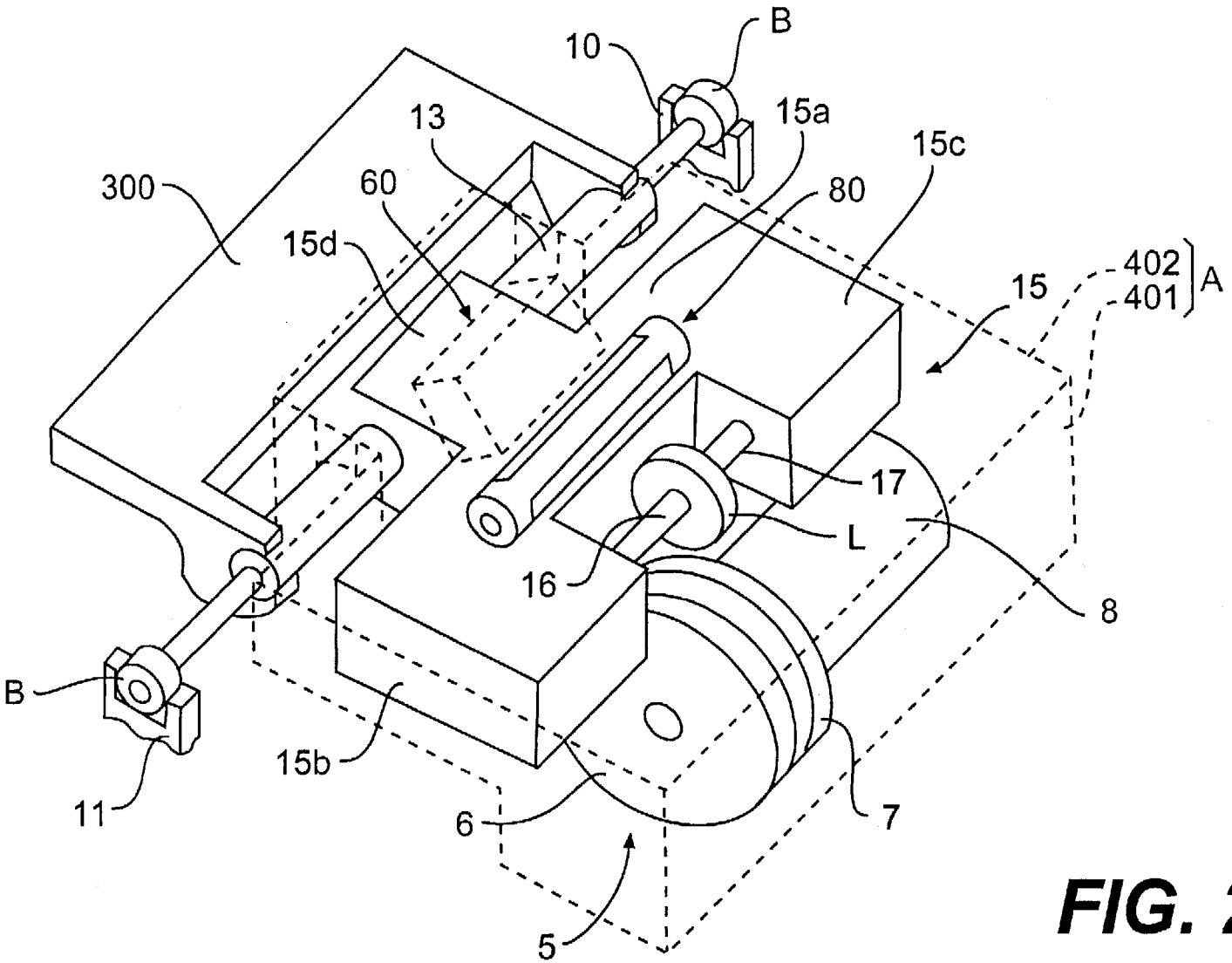
FIG. 2 is a schematic perspective view of the lens edging apparatus of FIG. 1, showing the location of a splash guard/trap assembly of the apparatus.

As shown in FIG. 2, a splash guard/trap assembly A is provided in the housing 1. The splash guard/trap assembly A consists of a lower case 401 (main body) open at the top thereof, and an upper case 402 which closes the top opening of the lower case 401. The grinding room BA is defined by the inner walls of the splash guard/trap assembly A and has the grinding wheel 5 and carriage 15 disposed therein.

The carriage 15 is adapted to swing vertically inside the grinding room BA. The swing arm 300 and the other parts are disposed outside the lower case 401 of the splash guard/trap assembly A. The upper case 402 of the splash guard/trap assembly A forms therein an opening C through which an uncut lens L is put into or taken from there as shown in FIG. 13. A window cover (not illustrated) is provided to close and open the opening C.

Figure 4:
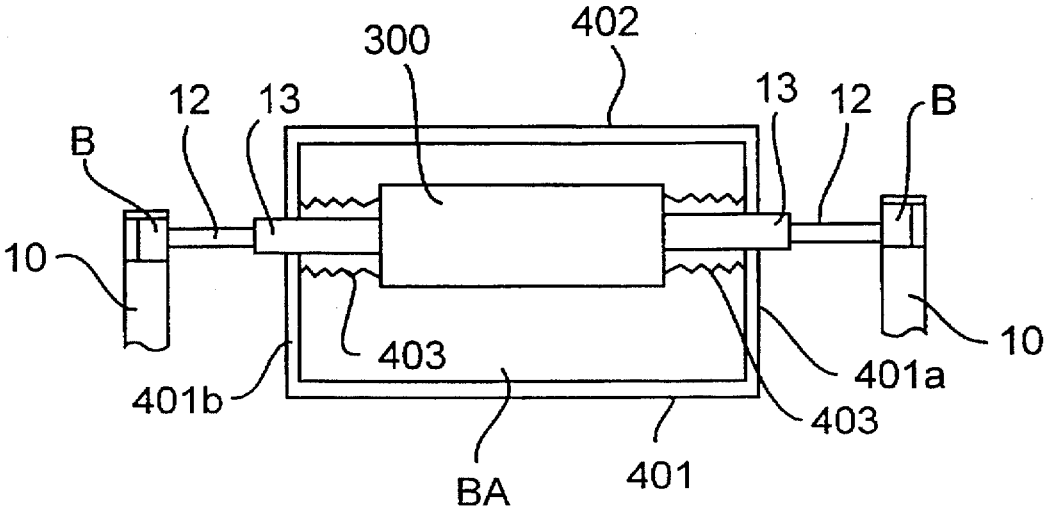
FIG. 4 is a sectional view taken along the line A—A of FIG. 3.

As seen in FIG. 4, water-proof hoses 403 are provided on the cylindrical shaft 13 and between the carriage 15 and lateral walls 401*a* and 401*b* of the lower case 401 of the splash guard/trap assembly A.

Carriage

The carriage 15 comprises a body 15*a*, parallel arms 15*b* and 15*c* extending forward from the body 15*a*, and a projection 15*d* formed at the central rear edge of the body 15*a* and extending rearward from the body 15*a*. The cylindrical shaft 13 is penetrated axially through the projection 15*d* and secured to it. Thus, the front end portion of the carriage 15 is vertically pivotable on the support shaft 12.

The carriage 15 has a lens rotating shaft 16 rotatably held on the arm 15*b* thereof, and a lens rotating shaft 17 held on the arm 15*c* thereof in line with the lens rotating shaft 16 to be rotatable and movable toward and away from the lens rotating shaft 16. An uncut lens L is to be held between ends, opposite to each other, of the lens rotating shafts 16 and 17, respectively. This construction is well known, and a description of this will be omitted.

The lens rotating shafts 16 and 17 are driven by a shaft driving unit comprising a pulse motor 18, and a power transmission 19 to convey a rotation of the pulse motor 18 to the lens rotating shafts 16 and 17. Both the pulse motor 18 and power transmission 19 are fixed in the carriage body 15*a*.

The power transmission 19 is made up of timing pulleys 20 fixed to the lens rotating shaft 16 and 17, respectively, a rotating shaft 21 rotatably held on the carriage body 15*a*, timing pulleys 22 fixed to the opposite ends, respectively, of the rotating shaft 21, timing belts 23 extended over the timing pulleys 20 and 22, a gear 24 fixed to the rotating shaft 21, a pinion 25 for delivering the power of the pulse motor 25, etc.

Figure 6A:
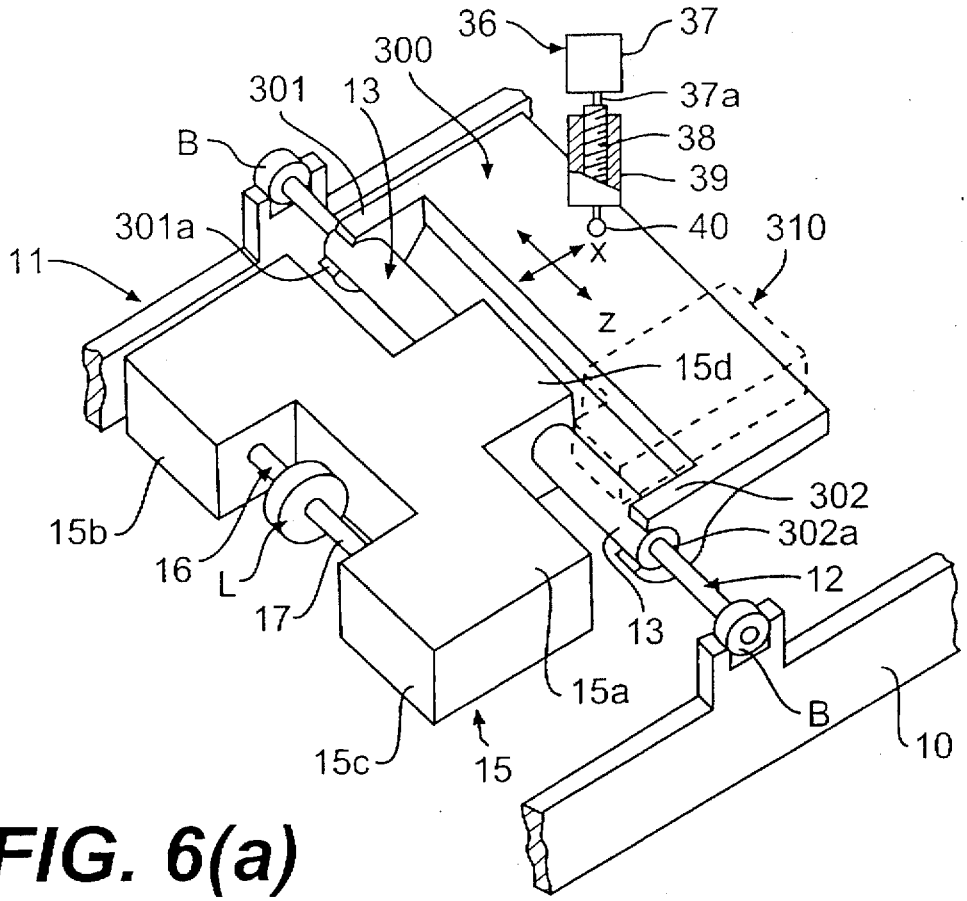
FIG. 6(*a*) is a schematic partial perspective view showing the relationship between the lens carriage and a swing arm shown in FIG. 1.
Figure 6B:
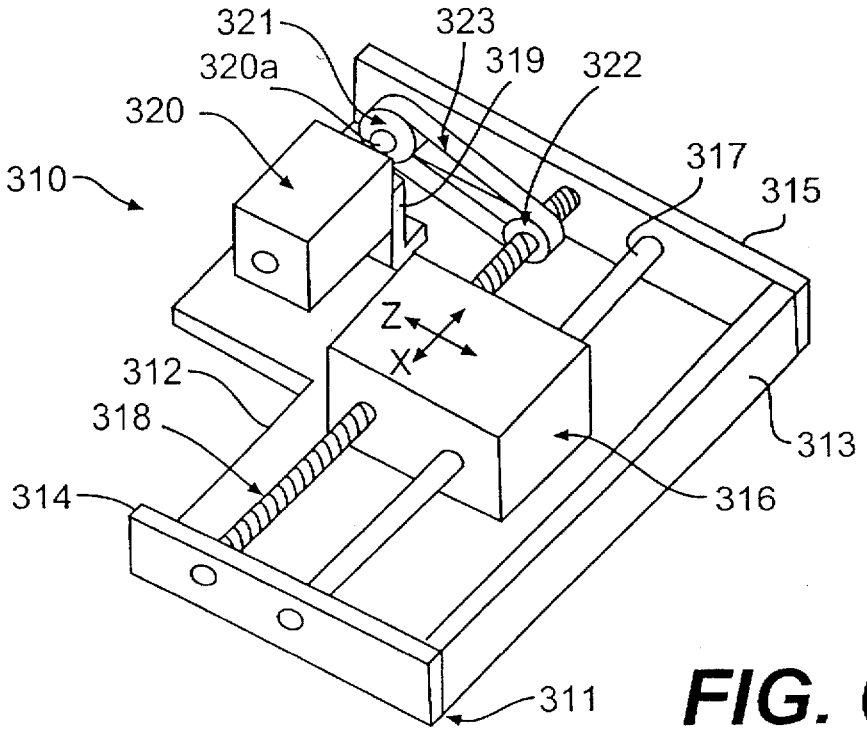
Figure 7:
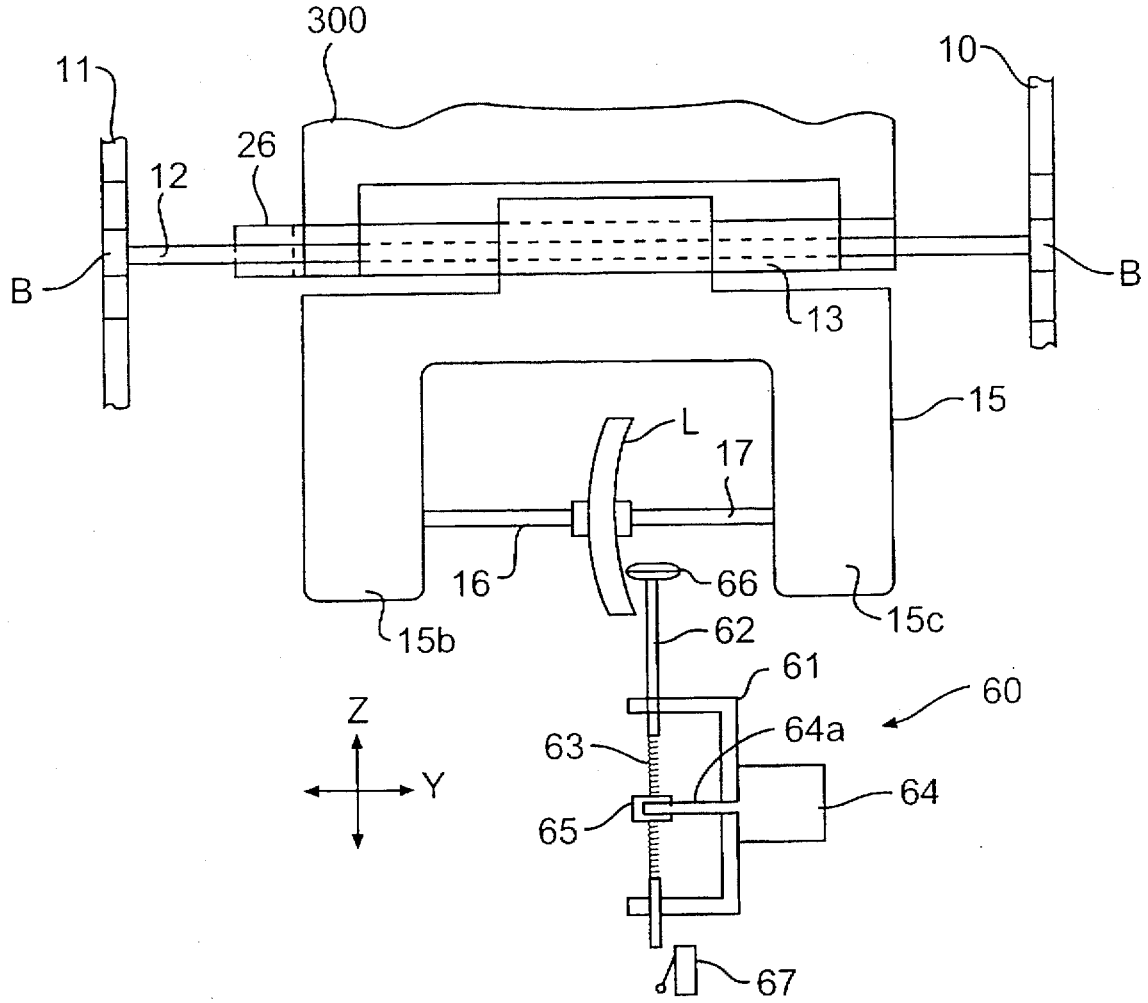
FIG. 7 is a schematic plan view showing the relationship between the carriage and a feeler shown in FIG 1.
Figure 8A:
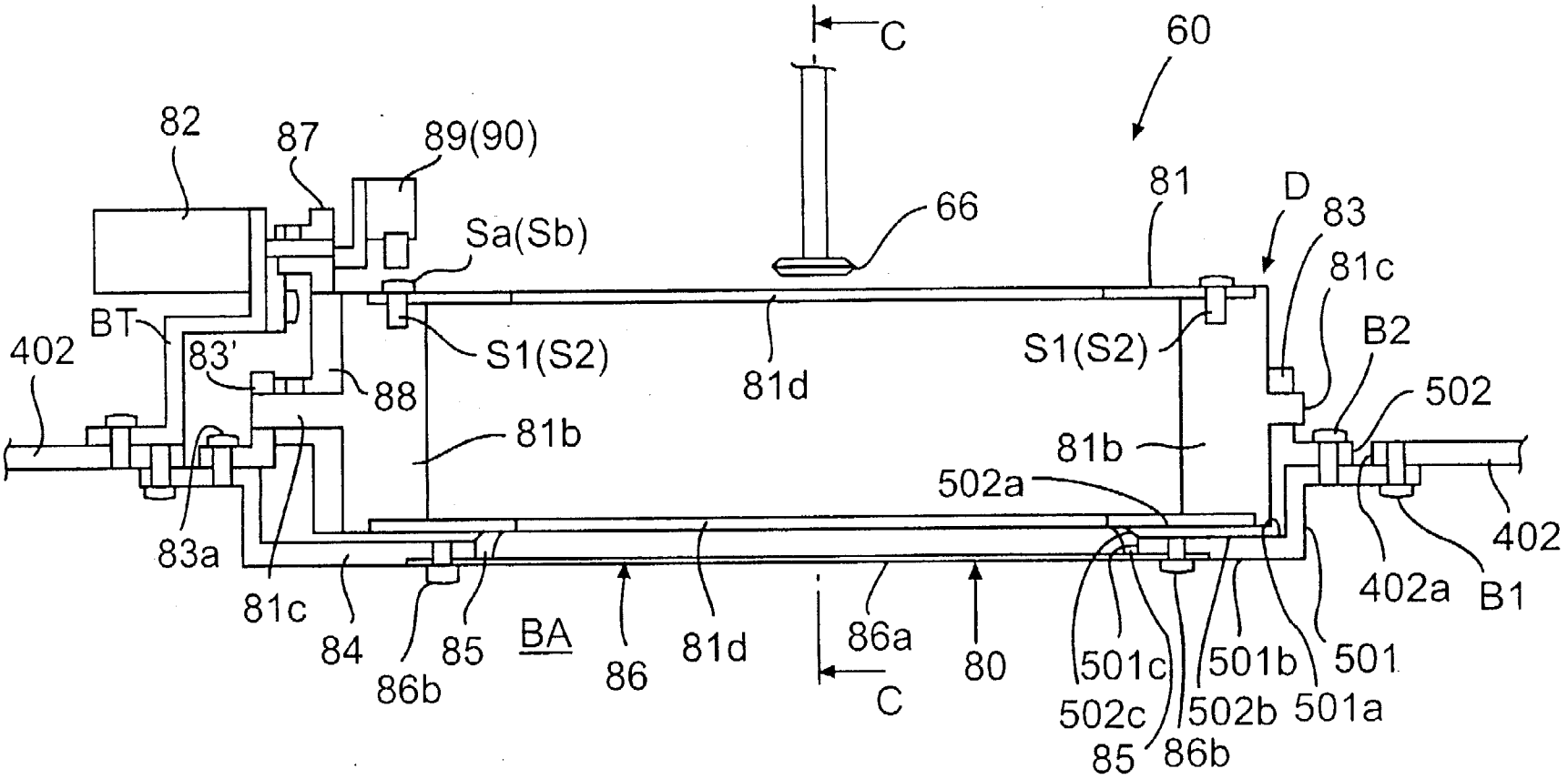
FIG. 8(*a*) is a sectional view taken along the line B—B of FIG. 3.
Figure 8B:
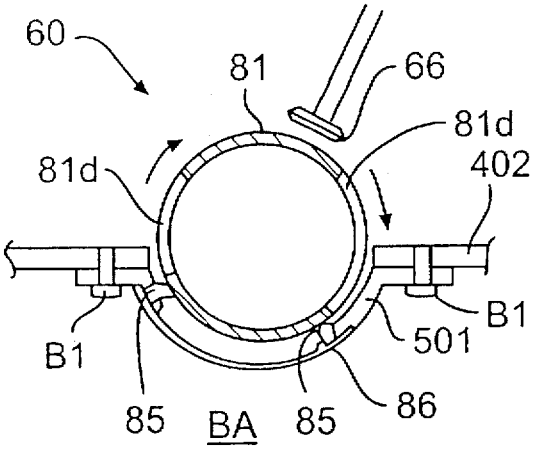
Figure 8C:
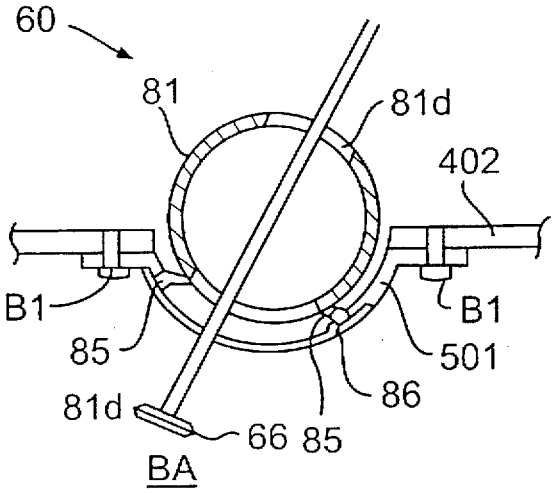
Figure 8D:
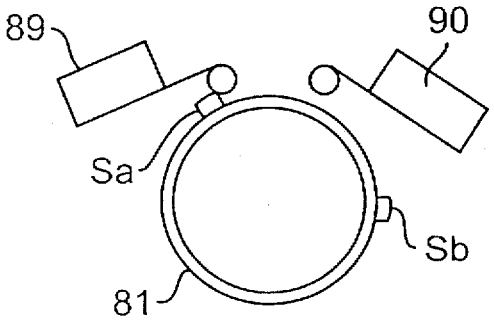

As shown in FIGS. 5 and 7, the support shaft 12 holds the top end of a support arm 26 to be movable horizontally (which is not shown in FIGS. 1 and 6). The support arm 26 is connected integrally to the cylindrical shaft 13 to be pivotable in relation to the cylindrical shaft 13 and movable in an axial direction of the support shaft 12. The support arm 26 has a guide shaft 26*a* parallel to the support arm 26, and both ends of the guide shaft 26*a* are fixed to the legs 9*b* and 9*c*, as shown in FIG. 5. The guide shaft 26*a* is penetrated through the lower end portion of the support arm 26 to guide the support arm 26 horizontally.

Carriage Horizontally-Moving Unit

The carriage 15 is disposed to be movable movably horizontally by a carriage horizontally moving means 29, as shown in FIG. 5.

The carriage horizontally moving means 29 is made up of a mount plate 30*a* fixed to the leg 9*c* and the mount plate 9*d*, a stepping motor 31 fixed to the front of the mount plate 30*a*, a pulley 32 fixed to an output shaft 31*a*, which penetrates through and projects from the back of the mount plate 30*a*, of the stepping motor 31, a pulley 32*a* fixed to the back of the leg 9*b* to be rotatable, and a wire 33 extended over the pulleys 32 and 32*a* and fixed to the support arm 26.

When the stepping motor 31 is run forward or reversely, the rotation of the motor 31 is transmitted via the pulley 32 and wire 33 to the support arm 26, and accordingly the support arm 26 is moved horizontally in the axial direction thereof along the support shaft 12 together with the cylindrical shaft 13 and carriage 15.

Actually, a first coil spring (not illustrated) is disposed as an urging means between the cylindrical shaft 13 and the bracket 10 or a bearing B for the bracket 10, and a second coil spring (also not illustrated) is disposed as an urging means between the support arm 26 and the bracket 11 or the bearing B for the bracket 11. When power supply to the stepping motor 31 is disconnected, the stepping motor 31 is freed, so that the carriage 15 is positioned substantially in the center of its horizontal moving range under the action of the first and second coil springs.

Also, the stepping motor 31 may be a variable motor. In this case, when the variable motor is turned off, it is freed, so that the carriage 15 is positioned substantially in the center of its horizontal (i.e., in the axial direction of the lens rotating shafts 16 and 17) moving range under the action of the first and second coil springs. In this case, the distance of horizontal movement of the carriage 15 can be measured by a rotary encoder (means for detecting the quantity of movement of the feeler). The rotary encoder may be constructed to work in interaction with either the wire 33 or the pulleys 32 and 32*a*.

Swing Arm 300 As mentioned above, the swing arm 300 is made of a plate. At both horizontal ends (in Z-axis direction) of the swing arm 300, projections 301 and 302 projecting forward are provided as shown in FIGS. 1 and 6(*a*). At the forward ends of the projections 301 and 302, semi-circular holders 301*a* and 302*a* are fitted on the opposite ends of the cylindrical shaft 13. The semi-circular holders 301*a* and 302*a* are fixed to the cylindrical shaft 13 by a fixing means (not shown), such as a vis (i.e., small screw) or an adhesive agent.

Working Pressure Adjusting Unit 310

The working pressure adjusting unit 310 has a mount frame 311 serving as a mount base, as shown in FIG. 6(*b*). The mount frame 311 comprises a base plate 312 disposed on the bottom face of one lateral side of the swing arm 300 in parallel with the swing arm 300, a side plate 313 extending in the back-and-forth direction (X-axis direction) and fixed to the right side of the base plate 312, a front side plate 314 fixed to the front edge of the base plate 312 and to the side plate 313, and a rear side plate 315 fixed to the rear edge of the base plate 312 and to the side plate 313. The mount frame 311 is fixed to the bottom face of the swing arm 300 with brackets or screws (not illustrated).

The working pressure adjusting unit 310 comprises a cubic weight 316 disposed above the base plate 312, a guide shaft 317 penetrated through the weight 316 and extending in the back-and-forth direction (X-axis direction), and a feed screw 318 threaded through an internally threaded hole (not illustrated) formed in the weight 316 in the back-and-forth direction (X-axis direction) and thus extending through the weight 316, as shown in FIG. 6(*b*). The guide shaft 317 is fixed at the opposite ends thereof to the side plates 314 and 315, and the feed screw 318 is also held at the opposite ends thereof in the side plates 314 and 315. The guide shaft 317 and feed screw 318 extend in parallel with each other.

The working pressure adjusting unit 310 further comprises a bracket 319 fixed to the top of the base plate 312, a pulse motor 320 fixed to the bracket 319 and having an output shaft 320 directed in the back-and-forth direction, a timing gear 322 fixed to the output shaft 320*a* of the pulse motor 320, a timing gear 322 fixed to the feed screw 318 in a position near the end of the timing gear 322, and a timing belt extended over the timing gears 321 and 322. Thus, a rotation of the pulse motor 320 is transmitted to the feed screw 318 via the timing gears 321 and 322 and timing belt 323.

Forward run of the pulse motor 320 causes the feed screw 318 to turn forward to move the weight 316 forward, while reverse run of a pulse motor 37, described later, causes the feed screw 318 to turn reversely to move the weight rearward.

Carriage Elevator

The swing arm 300 has a carriage elevator 36 provided at the rear edge thereof. The carriage elevator 36 comprises a pulse motor 37 disposed above the swing arm 300 and having an output shaft 37*a* directed downward and held inside the housing 1 by means of a bracket (not illustrated), a screw 38 coaxial and integral with the output shaft 37*a* of the pulse motor 37*a*, an internally threaded cylinder 39 in which the screw 38 is threaded to move the cylinder 39 up and down, and a spherical pushing member 40 formed integrally with the lower end of the cylinder 39. The internally threaded cylinder 39 is held in the housing 1 not to be rotatable about the axis thereof but to be movable up and down, and the pushing member 40 abuts on the top of the swing arm 300.

Lens Frame or Lens-Shaped Template Shape Measuring Unit

A lens frame or lens-shaped template shape measuring unit 46 (will be referred to as "lens frame shape measuring unit" hereafter) is provided as shown in FIGS. 1 and 13. The lens frame shape measuring unit 46 comprises a pulse motor 47 having an output shaft 47*a*, a rotating arm 48 installed on the pulse motor output shaft 47*a*, a rail 49 held on the rotating arm 48, a feeler support 50 movable longitudinally along the rail 49, a feeler 5 attached to the feeler support 50, an encoder 52 which detects a distance of movement of the feeler support 50, and a spring 53 which urges the feeler support 50 in one direction.

The lens frame shape measuring unit 46 may be constructed integrally with the lens edging apparatus.

Otherwise, it may be constructed separately from the lens edging apparatus and electrically connected to each other. Alternatively, the lens edging apparatus may be provided with a reader to read lens shape data which has been measured by the measuring unit 46 separated from the edging apparatus and has been saved temporarily on a recording medium, such as a floppy disc or IC card. Alternatively, it may be constructed to be capable of receiving lens shape data delivered from a eyeglass frame manufacturer on line.

Lens Edge Thickness Measuring Unit 60

Figure 3:
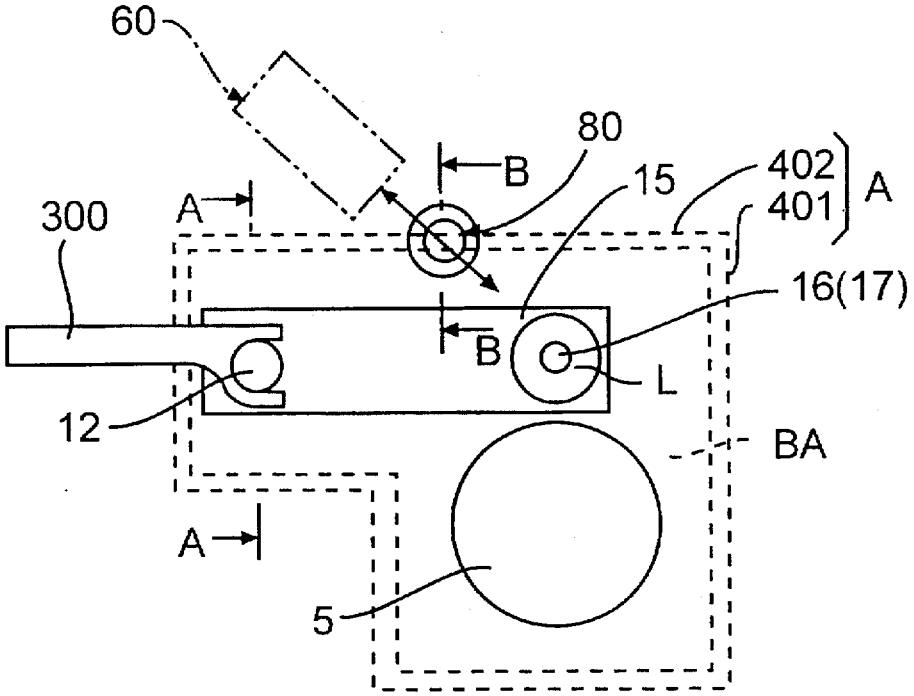
FIG. 3 is a side elevation of the apparatus of FIG. 2.

FIGS. 1 and 7 show a lens edge thickness measuring unit 60 separated from the carriage 15 for convenience of explanation. It should be noted, however, that actually this unit 60 is installed on the upper case 402 of the splash guard/trap assembly A covering the top of the carriage 15 as shown in FIGS. 2, 3 and 8(*a*) to 8(*c*), in order to accomplish a compact design of the carriage 15. In this embodiment, the lens edge thickness measuring unit 60 is disposed with the lower side thereof directed forward from the swing arm 300 correspondingly to an uncut lens L held by the lens rotating shafts 16 and 17 as shown in FIG. 1.

The lens edge thickness measuring unit 60 has a feeler 66 which can be moved forward into the grinding room BA and retracted from there through an opening 402*a* formed in the upper case 402. When grinding the uncut lens L by the grinding wheel assembly 5, a lens portion being ground is supplied with a grinding fluid from a grinding fluid supply nozzle (not illustrated). To prevent the grinding fluid, scattered or splashed from the uncut lens L and grinding wheel assembly 5, from coming through the opening 402*a* into the measuring unit 60 as shown in FIG. 8(*a*), a protecting or closing unit 80 for the measuring unit 60 is provided between the grinding room BA and the measuring unit 60. The protecting unit 80 is located in the opening 402*a* and installed on the upper case 402 as will be discussed below.

The opening 402*a* is closed with a mount plate 501 fixed to the upper case 402 with a binding screw B1. The mount plate 501 has a concave portion 501*a* formed therein and projecting into the grinding room BA. The concave portion 501*a* has an opening 501*c* formed in a bottom 501*b* thereof. Also there is provided inside the concave portion 501*a* another mount plate 502 having a concave portion 502*a*. The mount plate 502 is placed on the bottom surface of the concave portion 501*a* and fixed to the upper water-proof case 402 with a binding screw B2.

The protecting unit 80 for the measuring unit 60 comprises a bearing 83 formed integrally on the mount plate 502 along one end of the concave portion 502*a*, a bearing 83' provided in an opposite position to the bearing 83 and fixed to the mount plate 501 with a binding screw 83*a*, and a rotary body D inserted partially (a lower half thereof) into the concave portion 502*a*. The rotary body D comprises a cylinder 81, end wall members 81*b* disposed at the opposite ends of the cylinder 81, and binding screws S1 and S2 fixing the cylinder 81 to the end wall members 81*b*. The binding screws S1 are spaced in the direction of the circumference of the cylinder 81, and the binding screws S2 are also spaced in the same way. As shown in FIG. 8(*a*), the mount plate 502 has a bottom (bottom wall) 502*b*, and also an opening 502*c* is formed in the bottom 502*b* of the mount plate 502.

Figure 16:
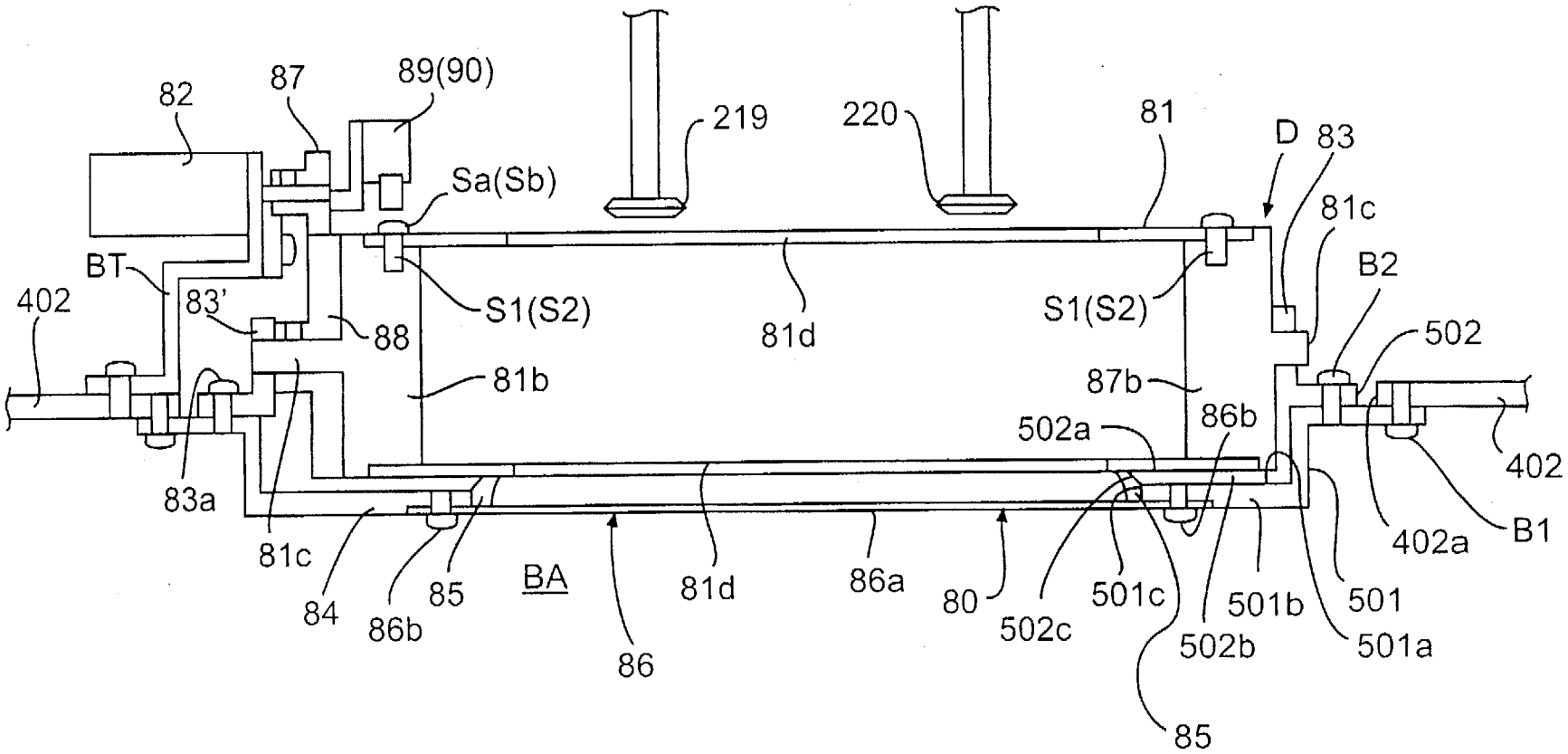
FIG. 16 is a sectional view, similar to FIG. 8(*a*), of a variant of the feeler and water-proof structure shown in FIG. 15.

The end wall members 81*b* have shafts 81*c* rotatably received in the bearings 83 and 83', respectively. The cylinder 81 has a pair of openings or windows 81*d* extending axially. The openings 81*d* are spaced 180 deg. from each other on the circumference of the cylinder 81. The feeler 66 (or feelers 219 and 220 as in FIG. 16) can be forwarded or retracted through the windows 81*d* into or from the grinding room BA.

There is provided a keep plate 86 along the perimeter of the opening 502*c*. It is fixed to the mount plate 501 with binding screws 86*b*. A packing 85 is provided on the keep plate 86 along the opening 501*c* of the mount plate 501 and secured to the bottom 501*b* of the mount plate 50. An opening 86*a* is formed in the keep plate 86. When the opening 501 is sealed, the packing 85 is resiliently pressed to the surface of the cylinder 81 along the entire perimeter of the window 81*d*. The packing 85 may be formed to be a nearly same size as, or a slightly larger size than, the windows 81*d*.

As shown in FIG. 8(*a*), a gear 88 fixed to one of the shafts 81*c* of the cylinder 81 is in mesh with a gear 87 fixed to an output shaft of a drive motor 82, and is driven by the drive motor 82 fixed to the upper case 402 by means of a bracket BT on which microswitches 89 and 90 are provided.

When a lens edge thickness measuring mode is selected, the cylinder 81 is rotated by the gears 86 and 87 driven by the motor 82 as shown in FIG. 8(*a*). Initially, the cylinder 81 takes positions shown in FIGS. 8(*b*) and 8(*c*), respectively. As the cylinder 81 is thus driven by the motor 82, it rotates from the position shown in FIG. 8(*b*) to a position shown in FIG. 8(*c*). The rotation of the cylinder 81 is controlled by the microswitches 89 and 90 which are adapted to detect heads sa and sb of the binding screws S1 and S2, respectively, as shown in FIG. 8(*d*).

The lens edge thickness measuring unit 60 comprises a bracket 61 having a C-shape as shown in FIG. 7 and installed on the carriage 15, a feeler shaft (arm) 62 held on the bracket 61 to be moved toward or away from the upper left of the rough grinding wheel 6 of the grinding wheel assembly 5, a rack 63 formed integrally with the feeler shaft 62, a pulse motor 64 fixed to the bracket 61, a pinion 65 fixed to an output shaft 64*a* of the pulse motor 64 and being in mesh with the rack 63, a disc-like feeler 66 provided integrally on one end of the feeler shaft 62, and a microswitch 67 provided at the other end of the feeler shaft 62 and fixed to the carriage 15. Note that the feeler shaft 62 is configured to be movable forward and backward in a direction perpendicular to the lens rotating shafts 16 and 17 (in line with the optical axis of the uncut lens L).

When the feeler 66 is retracted to a position off the lens L, the microswitch 67 is pressed by the other end of the feeler shaft 62 and is turned on.

Control Unit

There is provided a control unit comprising a calculation/control circuit 100 to which connected are a drive controller 101 which drives and controls the motor 8, a stepping motor 31, pulse motors 18, 37, 47 and 64 in the grinding unit, a lens frame data memory 102, an FPD/PD input device 103 to enter a frame-PD-value FPD and a pupil distance PD of an eyeglass wearer, a frame material input device 104 to enter information as to the eyeglass frame being a plastic frame, a correction value memory 105 in which a predetermined correction value C is stored correspondingly to the material of the eyeglass frame, and a working data memory 106 to store working data (Pi, Qi) under which the uncut lens L is cut or edged. The control unit further comprises a pulse generator 107.

The FPD/PD input device 103 may be a manual input device, such as ten keys, or may be a data reader which receives data from an ophthalmic unit on line or receives data from an ophthalmic data storing medium, such as a floppy disc or IC card.

When the drive controller 101 is put into operation by the calculation/control circuit 100, the pulse generator 107 is allowed to generate a drive pulse for the pulse motor 47.

Accordingly, the pulse motor 104 is activated with the pulse to rotate the rotating arm 48, thereby moving the feeler 51 along the inner circumference of a lens frame (lens opening) RF or LF of an eyeglass frame F.

The distance of movement of the feeler 51 is measured by the encoder 52 and is supplied in the form of a radial length f ρ i to the frame data memory 102 of the controller, and thereafter a same pulse as supplied from the pulse generator 107 to the pulse motor 47 is supplied in the form of an angle of rotation of the rotating arm 48, i.e., in the form of a radial angle f ρi, to the lens frame data memory 102 where it is stored as radius vector (f ρ i, f θ i) of the lens frame (or template).

In the foregoing, the construction of the lens edging apparatus according to the present invention has been described. The operation of the apparatus will be described below.

(1) Measurement of Lens Frame Shape

Figure 11:
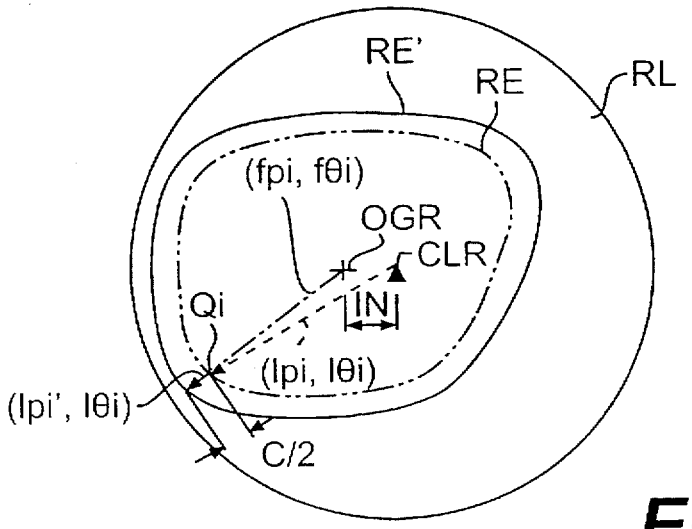
FIG. 11 is an explanatory drawing showing the relationship between an uncut lens and a shape of a lens frame into which an edged lens is to be fitted.
Figure 12:
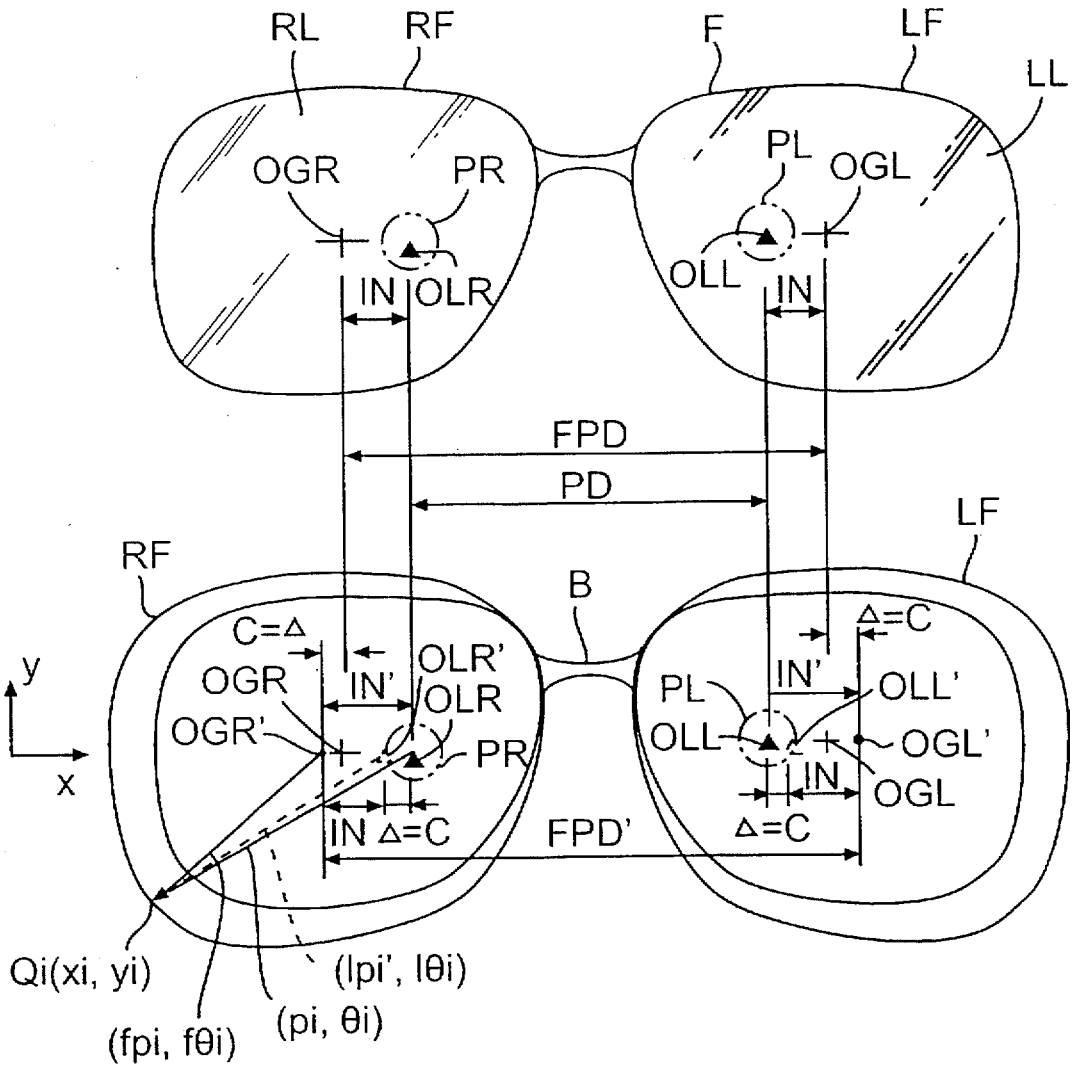
FIG. 12 is an explanatory drawing showing amounts of insetting and upsetting from the geometric center of the lens opening (lens frame) of the eyeglass frame of FIG. 1.

First, the lens frame shape measuring unit 46 is put into operation to measure the shape of a lens frame or template, such as a right lens frame RF of an eyeglass frame F shown in FIGS. 11 and 12, in order to determine radius vector (f ρ i, f θ i) (where in=1, 2, 3, . . . N) of the lens frame or template. The radius vector thus determined are stored in the lens frame data memory 102.

When the eyeglass frame is a plastic frame, the operator of the apparatus uses the frame material input device 104 to supply the information to the calculation/control circuit 100.

Also, using the FPD/PD input device 103, the operator supplies the calculation/control circuit 100 with a frame-PD-value FPD and a pupil distance PD of the eyeglass wearer. The calculation/control circuit 100 calculates, from the supplied frame-PD-value FPD, pupil distance PD and a correction value C read from the correction value memory 105, a corrected insetting value IN' taking account of a deviation of an optical center OLR of a lens for the right eye which is generated by the deformation of the lens frame after the lens is fitted into the lens frame, as follows:

$$IN'=\{(FPD-PD)/2\}-C/2 \quad (1)$$

After that, concerning each radius vector (f ρ i, f θ i) sampling point Θ 1 of the lens frame or template RF having its origin at the geometric center, stored in the frame data memory 102, the circuit 100 transforms the radius vector into an x-y coordinate to determine the following:

$$xi=f\rho\, i.\cos f\theta\, i$$

$$yi=f\rho\, i.\sin f\theta\, i \quad (2)$$

Further, the circuit 100 shifts the x-coordinate value for the insetting value IN' in the x-axis direction (horizontal direction) to determine working data (Pi, Θ i) (where i=1, 2, 3, . . . , N) based on the new origin as follows:

$$P\, i=\{(xi+IN')^2+yi^2\}^{1/2}$$

$$\Theta i=\tan^{-1}/\{yi(xi+IN')\} \quad (3)$$

The working data thus determined is stored into the working data memory 106.

The correction value C is selected to be 0.3 to 0.5 mm when the eyeglass frame F, especially, its lens frame, is made of an ordinary material, such as acetate, acrylic, Nylon, or propionate, and 0.8 to 1.0 mm when the frame is made of a highly thermoplastic material, such as epoxy resin or the like. For the convenience of a plurality of kinds of plastic frames, the frame material input device 104 is provided with a plurality of input keys to store into the correction value memory 105 a plurality of correction values C corresponding to frame materials.

(2) Measurement of Lens Edge Thickness Wi

Next, based on the working data (Pi, Θ i) corresponding to the radius vector (f ρ i, f θ i) determined in the equation (1), an edge thickness Wi of the lens L is calculated.

When the lens edge thickness measurement mode is selected by operating the keyboard 4, the calculation/control circuit 100 drives and controls the pulse motor 18 by means of the drive controller 101. The rotation of the pulse motor 18 is transmitted to the lens rotating shafts 16 and 17 through the power transmission 19 to move the uncut lens L to a position of contact with the feeler 66 according to the initial working data (P1, Θ 1) included in the working data (Pi, Θ i). For moving the uncut lens L to this initial position, a well-known structure can be used. Therefore, a detailed description of this is omitted.

The calculation/control circuit 100 has a counter, serving as a rotation detecting means, which counts the number of drive pulses supplied from the drive controller 101 to the pulse motor 18 and determines an angle of rotation (quantity of rotation) Θ i of the lens rotating shafts 16 and 17 based on the counted number. Note that a structure may be employed in which an angle of rotation of the rotating shaft 21 interrelated with the lens rotating shafts 16 and 17 is detected by a rotation detecting means, such as a rotary encoder, and thereby an angle of rotation Θ i of the lens rotating shafts 16 and 17 is determined.

Before the feeler 66 is moved to the contact position of the lens L and when the edge thickness measuring mode is selected, the windows of the cylinder 81 of the measuring-unit opening and closing unit 80 between the edge thickness measuring means 60 and the grinding room are designed to be opened.

When the edge thickness measurement mode is selected, the drive motor 82 shown in FIG. 8(*a*) drives and rotates the cylinder 81 by means of the gears 88 and 87 from the position shown in FIG. 8(*b*) to the position shown in FIG. 8(*c*). This positioning is controlled by the microswitches 89 and 90 which are adapted to detect the heads sa and sb of the screws S1 and S2, as shown in FIGS. 8(*a*) and 8(*d*).

After the cylinder 81 is rotated to the position shown in FIG. 8(*c*), the feeler 66 (or 219 and 220) is moved into the grinding room BA to measure the edge thickness of the lens L.

When the lens L is ground, grinding water and lens chips scattered or splashed from the lens and the grinding wheel often adhere to the cylinder 81. In a conventional lens edging apparatus in which windows in the cylinder 81 are closed with flat closing members, grinding water and lens chips which have adhered to the windows for the feeler 66 or 219 and 220 harden between the cylinder 81 and upper case 402. As a result, the closing member reaches an unmoved state. In another situation, when the windows are opened and closed, those by-products enter the grinding room BA, and bring trouble on the feeler 66.

In the position of the cylinder 81 shown in FIG. 8(*a*), as the cylinder 81 is rotated, the packing 85 slides in contact with the outer circumference of the cylinder 81 and removes lens chips and the like from the surface of the cylinder 81. Thus, the packing 85 prevents the lens chips, etc. from entering the measuring space of the feeler 66. Additionally, the packing 85 serves as a water-proof member between the cylinder 81 and the grinding room BA.

In comparison with the conventional mechanism for operating the flat closing member, the mechanism of the present invention which includes the rotary cylinder 81 can be made simple and compact.

The stepping motor 31 is driven by the calculation/control circuit 100 through the operation of the keyboard 4, and moves the carriage 15 leftward in FIG. 7. The distance (quantity) of this movement of the carriage 15 is input to the calculation/control circuit 100.

Thereafter, the drive controller 101 is operated under the control of the calculation/control circuit 100, and drives and controls the pulse motor 64. The feeler shaft 62 is moved by means of the pinion 65 and rack 63 to above the grinding wheel 5, and thereby the feeler 66 on the feeler shaft 62 is moved to the side of the lens L.

As the feeler shaft 62 is moved away from the microswitch 67, the microswitch 67 is turned off. The off-signal of the microswitch 67 is input to the calculation/control circuit 100. From the number of drive pulses supplied to the pulse motor 64, the calculation/control circuit 100 determines a distance which the feeler shaft 62 has moved after the microswitch 67 is turned off. The feeler 66 is moved to a position corresponding to initial working data (P1, Θ 1) included in the working data (Pi, Θ i) for the lens L.

In this condition, power is disconnected from the stepping motor 31 so as to freely rotate the stepping motor 31. Then, the carriage 15 and the support arm 26 are moved leftward in FIG. 4 under the action of first and second coil springs (not illustrated) until the right refracting surface of the lens L held by the lens rotating shafts 16 and 17 comes into contact with the feeler 66. At this time, the contact position corresponds to the initial working data (P1, Θ 1) of the lens L.

Further, the calculation/control circuit 100 drives and controls the pulse motors 18 and 64 from the initial contact position of the feeler 66 to shift the contact position of the feeler 66 sequentially according to the working data (Pi, Θ i) (where i=1, 2, 3, . . . , N). A distance of movement of the carriage 15 output by an rotary encoder 34 is stored in the working data memory 106 in relation to the working data (Pi, Θ i).

Likewise, the keyboard 4 is operated, and the stepping motor 31 is actuated by means of the calculation/control circuit 100 to move the carriage 15 rightward in FIG. 7. Thereafter, the feeler 66 is brought into contact with the left refracting surface of the lens L. The feeler 66 is moved sequentially according to the working data (Pi, Θ i) (i=1, 2, 3, . . . , N), and the distance of movement of the carriage 15 is calculated by the calculation/control circuit lo. In relation to the working data (Pi, Θ i), the distance of movement of the carriage 15 is stored in the working data memory 106.

Based on the calculated distances of movement of the carriage 15, the calculation/control circuit 100 determines contact positions of the feeler 66 with the right and left refracting surfaces of the uncut lens L in relation to the working data (Pi, Θ i). An edge thickness Wi of the lens L is then determined from the contact positions of the feeler 66 with the right and left refracting surfaces of the uncut lens L in relation to the working data (Pi, Θ i).

(3) Lens Edging

After the working data (Pi, Θ i) is stored in the working data memory 106, the calculation/control circuit 100 controls the drive controller 101 to drive the motor 8, and thereby the grinding wheel assembly 5 is rotated.

Under the control by the calculation/control circuit 100, the drive controller 101 supplies from the pulse generator 107 to the pulse motor 18 a pulse according to which the lens rotating shafts 16 and 17 are rotated by an angle Θ i, corresponding to the working data (Pi, Θ i) stored in the working data memory 106. In order to stop the carriage 15 from falling down at a position where the radius vector of the lens L is Pi for the angle Θ i, the pulse motor 37 is supplied with a pulse according to which the swing arm 300 is stopped at that position.

Thus, the lens rotating shafts 16 and 17 are rotated by the working radius vector angle Θ i. On the other hand, the lens RL is ground by the rough grinding wheel 6 in a state in which the lens RL is pressed against the rough grinding wheel 6 under the weight of the carriage 15, and the carriage 15 is lowered because of its own weight during grinding. The carriage 15 is lowered until the swing arm 300 moves up and touches the pushing member 40 so that the working radius vector of the lens RL is Pi.

At this time, if working pressure is defined as pressure generated when the lens RL is brought into contact with the rough grinding wheel 6 under the weight of the carriage 15, the working pressure is adjusted by the calculation/control circuit 100 according to the edge thickness Wi of the lens RL. In other words, the calculation/control circuit 100 increases the working pressure as the edge thickness Wi of the lens RL becomes larger, while decreasing the working pressure as the edge thickness Wi becomes smaller. The working pressure can be determined as a downward angular moment Fi of the carriage 15, as follows:

Assume that a downward angular moment of the carriage 15 under its own weight is f1, a downward angular moment of the swing arm 300 is f2, a downward angular moment of the portion of the working pressure adjusting unit 310 excluding the balancing weight 316 is f3, and a downward angular moment of the balancing weight 316 is fai (f1>f2+f3+fai). Then, the actual angular moment Fi for rotating the carriage 15 downward is:

$$Fi=f1-(f2+f3+fai)$$

Assume also that the balancing weight 316 weighs Wg, and the distance between the center of the support shaft 12 and the gravity of the balancing weight 316 is Bi. Then, the downward angular moment fai is:

$$fai=Wg\times Bi$$

The distance Bi can be changed by moving the balancing weight 316 back and forth under the control of the calculation/control circuit 100.

That is to say, as the edge thickness Wi of the lens RL becomes larger, the calculation/control circuit 100 controls the pulse motor 320 to rotate forward. Thus, the pulse motor 320 rotates the feed screw 318 to move the weight 316 forward. On the other hand, as the edge thickness Wi of the lens RL becomes smaller, the calculation/control circuit 100 controls the pulse motor 320 to rotate reversely, thereby rotating the feed screw 318 reversely. As a result, the weight 316 is moved rearward by the feed screw 318.

More particularly, the forward movement of the balancing weight 316 decreases the angular moment fai so that the downward angular moment Fi (working pressure) of the carriage 15 increases, whereas the rearward movement of the weight 316 increases the angular moment fai so that the downward angular moment (working pressure) Fi of the carriage 15 decreases.

Therefore, as the edge thickness Wi of the lens RL becomes larger, the working pressure increases. However, as the edge thickness Wi of the lens RL becomes smaller, the working pressure decreases. Thus, when an uncut lens having a large edge thickness is cut and edged by the rough grinding wheel 6, it is possible to prevent the rough grinding wheel 6 from slipping on the uncut lens surface. Also, when an uncut lens having a small edge thickness is edged by the rough grinding wheel 6, the uncut lens can be prevented from receiving an excessive working pressure from the rough grinding wheel 6 to the surface of the lens. In this way, the working pressure to an uncut lens can automatically be adjusted according to an edge thickness Wi of the uncut lens, and a lens edging operation can be performed efficiently without much labor. The calculation/control circuit 100 may be provided with a memory for storing appropriate working pressure determined by the type or kind of an uncut lens. If so, a desired working pressure will be read from the memory for pressure adjustment. For a plastic lens, for example, a working pressure of 3.5 kg is stored in the memory. For a glass lens, a working pressure of 5.0 kg is stored in the memory. In this way, the calculation/control circuit 100 controls the working pressure adjusting unit 310 while reading a working pressure from the memory.

These steps are taken for all the working data (Pi, Θ i), and an uncut lens L is roughly ground according to the working data, in order to obtain a lens RL having a similar shape to the lens frame RF.

When completing the rough grinding with the rough grinding wheel 6, the lens RL is moved by a well-known carriage moving unit (not illustrated) and is edged by a V-grooved grinding wheel 7. At this time, the calculation/control circuit 100 allows the lens RL to be finely edged based on an edge thickness corresponding to working data (Pi, Θ i) determined above.

Note that the lens RL is chucked by the lens rotating shafts 16 and 17 so that the optical center OLR thereof is aligned with the rotational axis of the lens rotating shafts 16 and 17.

These steps are taken for a left lens LL as well.

Accordingly, even when the lenses RL and LL are ground to have a slightly larger size to be fitted into the respective lens frames of a plastic frame, the optical centers of the lenses RL and LL fitted in the lens frames RF and LF, respectively, will precisely coincide with the optical centers (pupil's centers) of wearer's eyes.

In the above-mentioned series of working operations, a heat is generated when the lens is ground in contact with the grinding wheel, and lens chips are produced. To remove the heat and the chips, a grinding fluid is supplied through a grinding fluid pipe (not illustrated) to the grinding wheel. However, there is a situation in which the grinding fluid is not supplied because of the material of a lens to be ground.

For this reason, it is desired that the control unit and some other component parts of the apparatus do not receive such a grinding fluid, lens chips, and the like to the utmost. Therefore, as shown in FIG. 2, the grinding room is made up of only the lower case 401, the grinding wheel assembly and the carriage disposed therein. The control unit, and the like, are disposed separately from the grinding room.

As mentioned above, the grinding room includes the splash guard/trap assembly consisting of the upper and lower cases 402 and 401. The upper case 402 has an opening through which an uncut lens is moved toward and away from the grinding wheel assembly 5. Further, the housing 1 has an opening, as shown in FIG. 13, through which the lens L is attached or removed.

As shown in FIG. 4, splash-guard hoses 403 are provided on the cylindrical shaft 13 and between the carriage 15 and lateral walls 401*a* and 401*b* of the lower case 401 of the splash guard/trap assembly A.

With this construction, the splash guard/trap assembly A provides a partition between the grinding room and the other mechanisms including the control unit. Thus, the lower case 401 of the splash guard/trap assembly A provides a guard against splashes from the grinding wheel assembly 5. Splash guarding is provided for the horizontal movement of the carriage 15 as well as for the rotation of the support arm 26 of the swing arm 300 (to move an uncut lens vertically on the grinding wheel).

Also, since the grinding wheel assembly 5 is not movable, the rotation of the grinding wheel shaft and the lens rotating shafts 16 and 17 should be protected against splashes from the grinding wheels. The movement including the horizontal movement and vertical swing of the carriage can be protected against the splashes by the protective or splash-guard hoses 403 provided on the cylindrical shaft 13 as shown in FIG. 4.

Second Embodiment

In the first embodiment, one feeler 66 is used to measure the edge thickness of an uncut lens. However, the present invention is not limited only to the first embodiment. A lens edge thickness measuring unit 200 shown in FIG. 15 may be used as an alternative, in order to measure the edge thickness of an uncut lens.

(1) Lens Edge Thickness Measuring Unit

This lens edge thickness measuring unit 200 is provided opposite to the grinding wheel assembly 5. As shown in FIG. 15(*a*), the unit 200 comprises parallel brackets 201 and 202 spaced from each other in the back-and-forth direction and fixed onto the housing 1, a pair of parallel guide rails 203 and 204 bridged and fixed between the brackets 201 and 202 and extending in the back-and-forth direction, and a plate-like moving base 205 held on the guide rails 203 and 204 to be movable toward and away from the carriage 15. As shown in FIGS. 15(*b*) to 15(*d*), the lens edge thickness measuring unit 200 further comprises a rack 206 disposed in parallel to the guide rails 203 and 204 and fixed to the bottom of the moving base plate 205, a feeler moving pulse motor 207 disposed under the moving base plate 205 and fixed to the housing 1, a pinion 208 fixed to an output shaft 207*a* of the pulse motor 207 in mesh with the rack 206 to move the feeler, and a microswitch MS fixed to the bracket 202 to detect the origin of the moving base plate 205. The pulse motor 207 is driven to rotate the pinion 208. Engagement of the pinion 208 with the rack 206 moves the moving base plate 205 toward and away from the carriage 15.

Furthermore, the unit 200 comprises a mount plate 209 fixed with a spacing above the moving base plate 205, a mount plate 210 fixed with a spacing above the moving base 209, gears 211 and 212 held rotatably between the mount plates 209 and 210 and in mesh with the gears 211 and 212, a variable motor 213 fixed onto the mount plate 209, a pinion 214 fixed to an output shaft 213*a* of the variable motor 213, which extends through the mount plate 209 and is in mesh with the gear 211, a rotary encoder 215 fixed on the mount plate 209 (means for detecting the quantity of movement of a feeler), and a pinion 216 fixed to an output shaft 215*a* of the rotary encoder 215, which extends through the mount plate 209 and is in mesh with the gear 212.

The unit 200 further comprises feeler shafts 217 and 218 held at base ends 217*a* and 218*a* on shafts 211*a* and 212*a* of the gears 211 and 212, respectively, which extend through the mount plate 210, a first disc-like feeler 219 and a second disc-like feeler 220 provided integrally on the free ends of the feeler shafts 217 and 218, respectively, a spring 221 disposed between the feeler shafts 217 and 218, and a microswitch 222 positioned near the base ends 217*a* of the feeler shaft 217 and fixed on the mount plate 210.

When the variable motor 213 is driven, its rotation is transmitted to the gears 211 and 212 via the output shaft 213*a* and pinion 216, the feeler shafts 217 and 218 are then pivoted in opposite directions, respectively, against the force of the spring 221, so that the feelers 219 and 220 are spaced away from each other. At this time, the rotation of the gear 212 is transmitted to the rotary encoder 215 via the pinion 216 and output shaft 215*a*, and the distance between the first and second feelers 219 and 220 can thus be known from the output from the rotary encoder 215.

When the feelers 219 and 220 are made to touch each other under the action of the spring 221, the microswitch 222 is pressed and turned on by the base end 217*a* of the feeler shaft 217.

The outputs from the rotary encoder 215 and microswitches 222 and MS are supplied to the calculation/control circuit 100, and thereby the calculation/control circuit 100 controls the pulse motor 207 and variable motor 213 by means of the drive controller 101.

When the moving base plate 205 is moved toward the carriage 15, the calculation/control circuit 100 counts the number of drive pulses supplied to the pulse motor 207 after the microswitch MS is turned off to calculate a distance of movement of the moving base plate 205 toward the carriage 15, i.e., a distance of movement of the feelers 219 and 220 toward the carriage 15.

(2) Measurement of Lens Edge Thickness

An edge thickness Wi of an uncut lens L is determined based on working data (Pi, Θ i) corresponding to a radius vector (f ρ i, f θ i) determined as in the first embodiment.

More particularly, when the edge thickness measurement mode is selected, the calculation/control circuit 100 drives and controls the variable motor 213 as mentioned above to increase the distance between the feelers 219 and 220. It then drives the pulse motor 207 to move the moving base 205 toward the carriage 15, thereby moving the feelers 219 and 220 to both sides of the lens L. It then stops the motors 207 and 213 from operating. Thus, the feelers 219 and 220 are made to touch the left and right refracting surfaces of the lens L under the action of the spring 221.

In this condition, the calculation/control circuit 100 drives the pulse motor 18 and also the pulse motor 207 to shift the contact position of the feelers 219 and 220 with the lens L according to the working data (Pi, Θ i). Thus, the circuit 100 determines a distance (edge thickness of the uncut lens L) between the feelers 219 and 220 based on the output from the rotary encoder 215 in relation to the working data (Pi, Θ i).

If an uncut lens L has a stepped lens portion as in a bifocal lens, the feeler 66 will not able to go beyond the stepped lens portion, and errors will be produced, when the feeler 66 is positioned at a lower surface of the stepped lens portion of the lens L. Note that there is a situation in which the feeler 219, not the feeler 220, which will be described later, cannot go beyond a stepped lens portion of the lens L.

Figure 9:
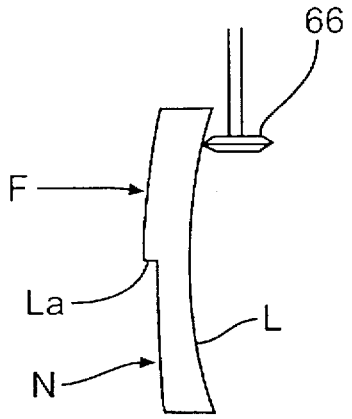
FIG. 9 is a sectional view showing the contact between an EX lens and a feeler.

In such a situation, it is possible to automatically determine whether the lens is a bifocal lens or not, as follows:

Generally, a bifocal lens has a stepped lens portion between a distance portion and a near or intermediate portion of the lens, as shown in FIG. 9.

To solve the above problem, it is judged that an uncut lens under measurement is a bifocal lens (EX lens), based on data obtained when the feeler moves from the distant portion to the near portion at the a stepped lens portion, so that the feeler can be moved smoothly.

Figure 10:
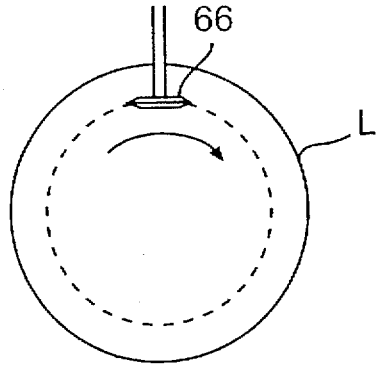
FIG. 10 is a front view showing the contact between the EX lens and the feeler.

For measurement of an edge thickness of an uncut lens L, the lens L is rotated in relation to the feeler 66 or feelers 219 and 220 as shown in FIG. 10. In FIG. 10, the locus of the feeler 66 or feelers 219 and 220 is made circular for the convenience of explanation. However, in fact, the feelers 66 or feelers 219 and 220 follow a lens-contour-shaped locus corresponding to working data (ρ i, θ i). In this case, the feeler can move smoothly from a higher surface to a lower surface with no problem. However, after the lens further rotates and the feeler reaches an other-side stepped lens portion on the same refracting surface, the feeler must move from the lower surface to the higher surface. This causes a problem.

First, when the feeler moves from a high surface to a low surface of a stepped lens portion, it is determined whether the stepped lens portion (i.e., a difference in surface level) is larger than a predetermined value, for example, 0.5 mm or more. Also, based on changes in the number of drive pulses for rotation of the lens rotating shafts 16 and 17 by the pulse motor 18 to rotate the uncut lens L and based on the quantity of movement of the feeler, it is determined whether the stepped lens portion changes gradually or abruptly, thereby determining whether the uncut lens L is an EX lens or not.

Generally, in an EX lens, a stepped lens portion is in a predetermined width in the horizontal direction of the working center of the lens to be edged. Thus, it is possible to determine whether an uncut lens L is an EX lens or not, based on whether or not a steep stepped lens portion exists in a predetermined range of about 5 mm upward and about 8 mm downward, for example, from the working center of the lens.

When the uncut lens L is determined to be an EX lens, an other-side position of the stepped lens portion is estimated to exist near the horizontally opposite position to that of a one-side position of the stepped lens portion. Briefly, the other-side position of the stepped lens portion is estimated to exist at an opposite position having an angle of 180 deg. from the position of the one-side position of the stepped lens portion.

When a stepped lens portion is determined as a stepped lens portion of an EX lens, the measurement is resumed from a position of the stepped lens portion, and is stopped before an estimated other-side position of the stepped lens portion. The feeler 66 or feelers 219 and 220 are then opened and returned temporarily to the measurement resuming position, i.e., the first position of the stepped lens portion. From the first position, the lens rotating shafts 16 and 17 are rotated reversely by the pulse motor 18 so that the feeler can move from the high surface to the low surface, and move to the first position or a position beyond the first position. The thickness of the entire lens edge along the working locus can be measured from both these data. In FIG. 10, the feeler 66 or feelers 219 and 220 are shaped to have a shape similar to a so-called benzene-ring. However, the feeler of the present invention is not limited to this shape. The feeler may have any other suitable shape, such as a circular or spherical shape. The feeler may be either rotatable or not.

In this way, an uncut lens is automatically determined as an EX lens, and the feeler is prevented from being stopped at an other-side position of a stepped lens portion of the lens, and thus an edge thickness of the lens along a working locus can be measured.

Figure 14A:
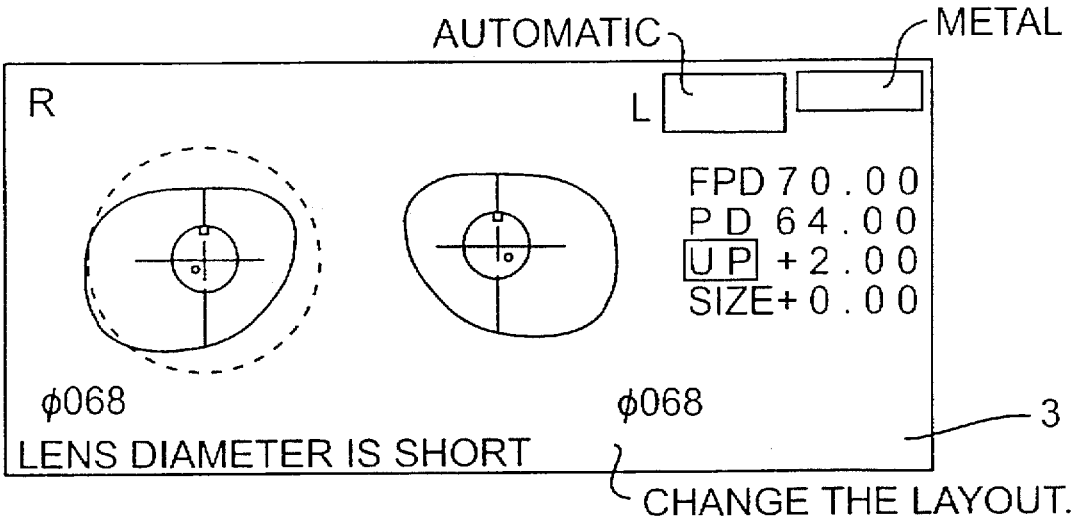
FIGS. 14(*a*) and 14(*b*) are explanatory drawings of the display panel of the lens edging apparatus of FIG. 13.
Figure 14B:
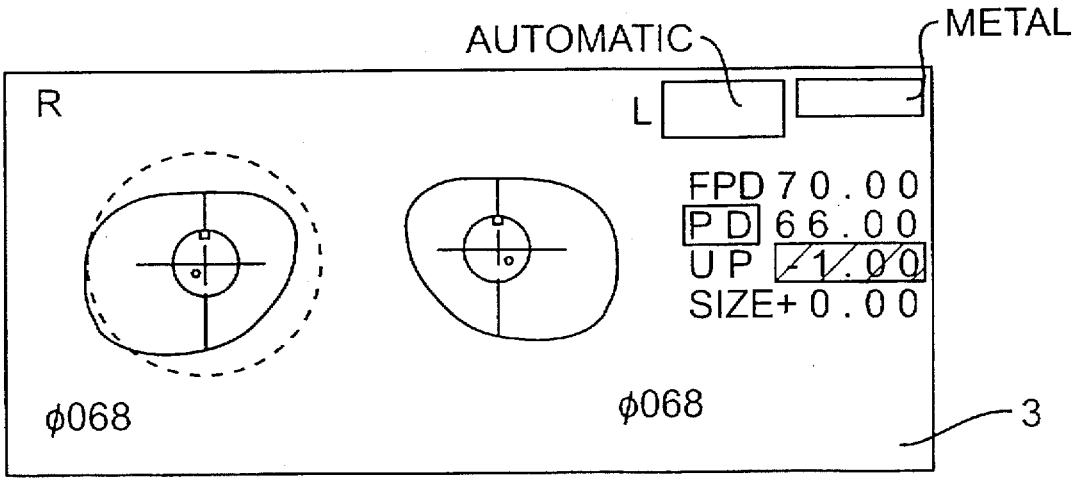
Figure 15A:
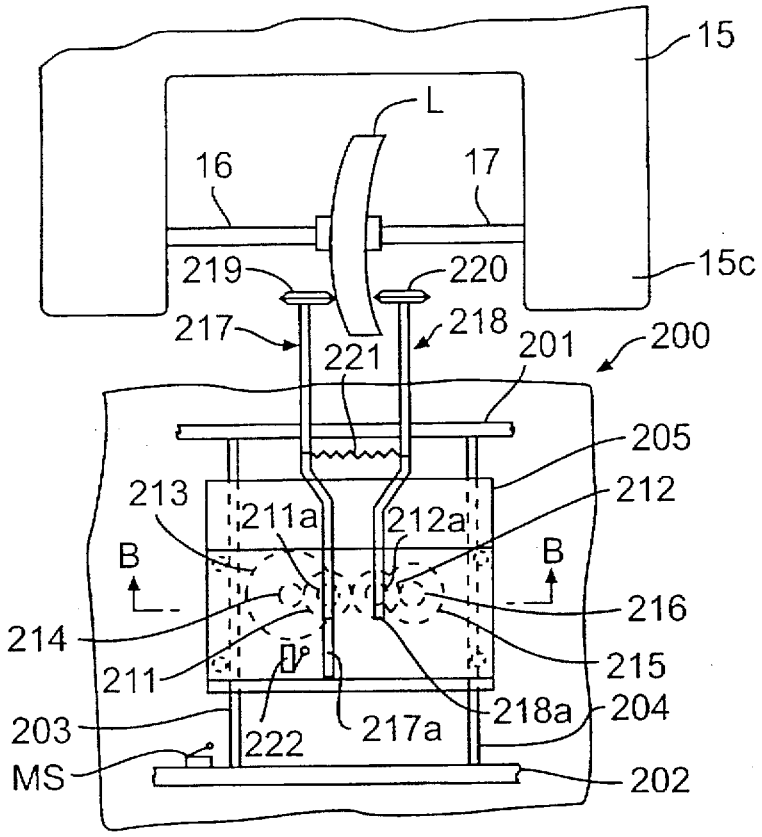
FIG. 15(*a*) is a schematic plan view of another embodiment of the edge thickness measuring unit of the lens edging apparatus according to the present invention, showing the relationship between the lens carriage and the feeler.
Figure 15B:
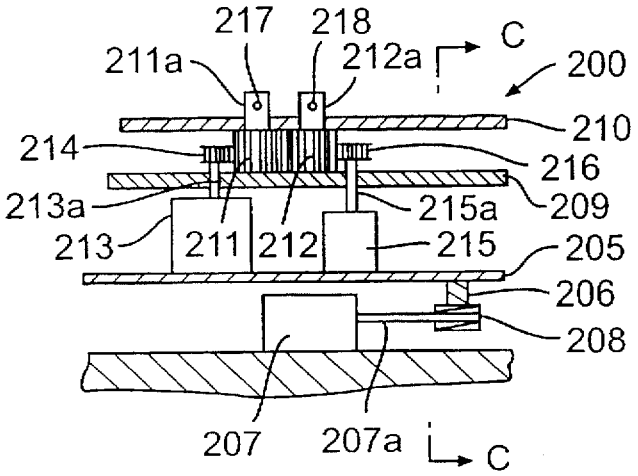
Figure 15C:
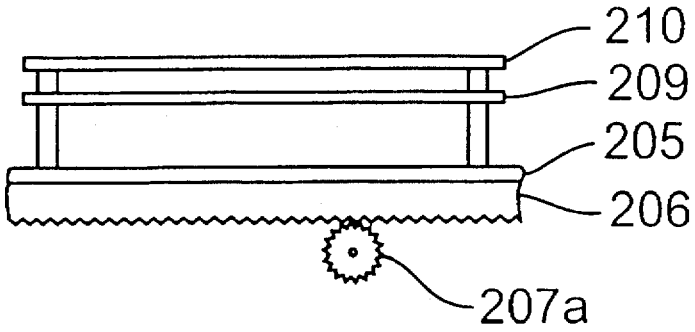
Figure 15D:
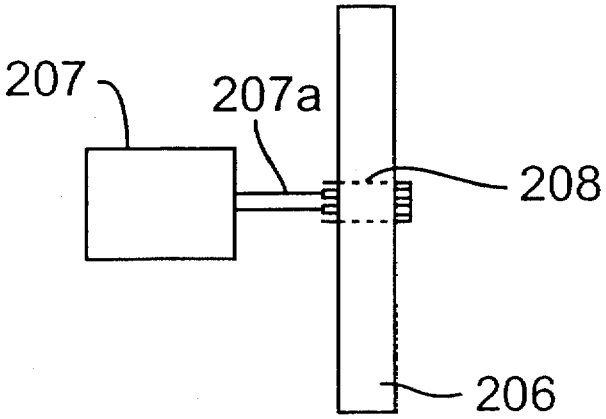

FIG. 14 enlargedly shows an example of the LC display 3 shown in FIG. 13. The display shows various screens, such as those shown with reference to each measurement or working mode.

By operating the keyboard 4 while watching the LC display, the operator can change the working mode and numeric settings.

When the keyboard 4 is operated, the screen on the LC display changes according to the operation. In the example shown in FIG. 14(*a*), "UP" is highlighted, which means that a numeric value following this item may be changed.

In the example of FIG. 14(*a*), the numeric value following "UP" is "+2.00". When this numeric value is changed to "−1.00", for example, by operating the keyboard 4, "−1.00" appears on the display. However, there is a fear that an operator might mistake the sign "−" for "+".

In order to banish this fear, a structure is employed in which when, for example, the sign "+" is changed to "−", the numeric value or the sign is hatched, or both of the numeric value and the sign are hatched while being highlighted, as shown in FIG. 14(*b*). Therefore, the signs "−" and "+" are easily distinguished.

As described in the foregoing, according to the present invention, even if an uncut lens has a large stepped lens portion, it is possible to detect the degree of a difference in surface level and, based on detected data, accurately measure the edge thickness of the lens along a working locus along which the uncut lens is cut and edged.

Additionally, according to the present invention, it is possible to produce an eyeglass lens having an exact fit to an eyeglass frame and provide nice-looking eyeglasses according to the taste of an eyeglass wearer.

What is claimed is:

1. A lens shape measuring apparatus, comprising:

lens rotating shafts to rotatably hold an uncut lens;

shaft rotating means for rotating said lens rotating shafts about an axis thereof;

rotation detecting means for detecting a quantity of rotation of said lens rotating shafts;

a feeler disposed in contact with a working locus of a refracting surface of the uncut lens;

feeler moving means for moving said feeler in a direction perpendicular to an optical axis of the uncut lens, distance detecting means for detecting a distance of movement of said feeler relative to the uncut lens in a direction of the optical axis of the lens; and control means for detecting a difference in surface level of the uncut lens, based on output of said rotation detecting means and output of said distance detecting means, and controlling the contact of said feeler with the refracting surface of the uncut lens.

2. The apparatus as set forth in claim 1, wherein, said control means brings said feeler into contact with one of front and rear refracting surfaces of the lens, and controls said shaft rotating means and said feeler moving means to move said feeler relatively with said one of front and rear refracting surfaces along the working locus and measure said one of front and rear refracting surfaces, and thereafter said control means brings said feeler into contact with the other refracting surface of the lens, and controls said shaft rotating means and said feeler moving means to move said feeler relatively with said other refracting surface along the working locus and measure said other refracting surface, and based on measurement results of the front and rear refracting surfaces obtained from the output of said rotation detecting means and the output of said distance detecting means, said control means calculates an edge thickness of the lens along the working locus.

3. The apparatus as set forth in claim 1, wherein a pair of feelers are disposed to come into contact with front and rear refracting surfaces of the lens, respectively, said distance detecting means measuring an interval between the pair of feelers, said control means calculating an edge thickness of the lens along the working locus based on output of said rotation detecting means and output of said distance detecting means.

4. The apparatus as set forth in any one of claims 1 to 3, wherein said control means determines whether a variation of measurement data measured by said feeler along the working locus is gradual or abrupt, based on the output of said rotation detecting means and the output of said distance detecting means, and, if abrupt, said control means judges that the lens is a bifocal lens, and allows said feeler to again measure the lens from a position where the lens has a level difference causing an abrupt change to another position of having a level difference.

5. The apparatus as set forth in claim 4, wherein when said control means judges that the lens is a bifocal lens, said control means estimates a next position where the lens has a level difference, based on the position of the abrupt change, and brings said feeler into contact with the lens before the position of the abrupt change, while allowing said shaft rotating means to reverse said lens rotating shafts for a start of measurement and stopping said feeler before the estimated next position on a side opposite to the position of the abrupt change on a same refracting surface of the lens.

6. The apparatus as set forth in claim 4, wherein when said feeler is moved from a lens portion having a higher surface level to a lens portion having a lower surface level, said control means can measure the position of the abrupt change.

* * * * *